United States Patent [19]

Keyes, IV et al.

[11] Patent Number: 4,627,788

[45] Date of Patent: Dec. 9, 1986

[54] ADAPTIVE GAIN COMPRESSOR SURGE CONTROL SYSTEM

[75] Inventors: Marion A. Keyes, IV, Chagrin Falls; Jeremiah J. Shaffer, Euclid, both of Ohio

[73] Assignee: The Babcock & Wilcox Company, New Orleans, La.

[21] Appl. No.: 642,284

[22] Filed: Aug. 20, 1984

[51] Int. Cl.[4] ..... F04B 27/02

[52] U.S. Cl. ..... 415/11; 415/27; 417/201

[58] Field of Search ..... 415/11, 26, 27, 28; 417/199 R, 201, 202

[56] References Cited

U.S. PATENT DOCUMENTS

| | | | |
|---|---|---|---|
| 3,276,674 | 10/1966 | Hens | 415/28 |
| 4,046,490 | 9/1977 | Rutshtein et al. | 415/27 |
| 4,139,328 | 2/1979 | Kupen et al. | 425/27 |
| 4,142,838 | 3/1979 | Staroselsky | 417/28 |

*Primary Examiner*—Louis J. Casaregola

*Attorney, Agent, or Firm*—Vytas R. Matas; Robert J. Edwards

[57] ABSTRACT

An adaptive gain surge control system (18) is disclosed for a centrifugal compressor (14) which reacts to both normal and emergency surge conditions by controlling a bypass valve (48) across the compressor (14) inlet and outlet in response to a variable gain (G) determined by the offset (d) of the surge control line from the surge line of the compressor.

3 Claims, 7 Drawing Figures

ADAPTIVE GAIN COMPRESSOR SURGE CONTROL SYSTEM

TECHNICAL FIELD

The present invention relates to compressor surge controls generally and in particular to surge controls having a variable gain feature which provides a first gain control for slow surge conditions and a second large gain control for emergency conditions.

BACKGROUND ART

Surge conditions occur in a centrifugal compressor when the inlet flow is reduced to the extent that the compressor, at a given speed, can no longer pump against the existing pressure head. At this point, a momentary reversal of flow occurs along with a drop in pressure head. Normal compression resumes and the cycle repeats. This causes a pulsation and shock to the entire compressor and piping arrangement. If left uncontrolled, damage and danger to the compressor could result.

All centrifugal compressors are supplied with characteristic and setpoint curves defining the zones of operation for the compressor. These compressor "maps" illustrate the surge area and the "stonewall" area of pumping limit of the turbomachinery. As shown in FIG. 1*a*, the surge limit line is plotted against a discharge pressure versus flow rate relationship. Taking into account no changes in speed, or inlet gas temperature the surge control line can be plotted with this equation.

$$\text{SURGE CONTROL LINE} = \text{\% OF CONTROL MARGIN DESIRED} \times \frac{\Delta P \text{ ACROSS COMPRESSOR}}{\Delta P \text{ ACROSS INLET ORIFICE}} \quad \text{(EQ. 1)}$$

Three common forms of presently used surge control lines are shown in FIG. 1. The one position of this line is parallel to the surge limit line (FIG. 1*a*). To minimize recirculation, the surge control line should be set as close to the surge limit line as possible. Setting the control line with a slope less than that of the limit line (FIG. 1*b*) can lead to excess recirculation at high pressures, and surge at low pressures during stopping and startup. The third method is to select a minimum safe volumetric flow, and set a vertical control line (FIG. 1*c*). This can lead to excess recirculation at low pressures, and surge at high pressures. Many systems measure flow in the discharge without correcting for suction condtions. This gives maximum recirculation with minimum surge protection.

In the various surge controls, control is accomplished by opening a bypass valve around the compressor or blowing off gas to atmosphere to maintain minimum flow through the compressor. Since bypassing or blowing off gas wastes power, it is desirable to determine surge flow as accurately as possible to avoid bypassing fluid unnecessarily while maintaining safe operation. However, determining surge flow is often not a simple matter, but a complex one. Surge conditions can be approached slowly or quickly and thus situations may occur when the normal surge control loop opening the bypass valve opens the bypass valve too slowly to prevent a surge condition. Prior art systems used a second control loop for such emergency surge conditions to provide speedy and complete opening of the bypass valve. An example of such a control system having two separate control loops may be found in U.S. Pat. No. 4,142,838.

Clearly such prior art two mode control systems having two separate control loops were complicated, unstable, expensive, and required extensive coordination to properly switch between these two control loops. What was needed was a simple, single control loop which would provide control for both normal surge and emergency fast surge conditions.

SUMMARY OF THE INVENTION

The present invention solves the problems associated with prior art surge controls as well as others by providing a surge control system for a centrifugal compressor which provides surge control for both normal and fast acting emergency surge conditions using the same single control loop. The present single loop control system will initiate normal low gain surge control and emergency anti-surge action by increasing the gain of the controller in the single control loop to quickly and fully open the bypass valve during fast acting emergency surge conditions.

To accomplish this the control system of the present invention operates on a two mode principle. The usual mode of bypass valve operation is utilized for slow upsets or normal surge conditions. Slow upsets can be counteracted through a normal modulating control of the control loop set at a first gain factor thereby offsetting the surge condition at maximum efficiency energy usage by limiting the amount of bypass flow through the relief valve. The second mode of operation is the emergency mode. The emergency mode comes into play during a fast upset or emergency surge condition. The controller will offset such a fast upset by changing the controller to a high gain factor to provide a step function command to the relief valve to quickly and completely open. By stepping open the relief valve efficiency is sacrificed for maintaining the protection of the compressor.

The response of the controller to input conditions depends upon the proportional control mode band width and integration time of the integral mode of the controller. These parameters influence the stability of the control system. Decreasing the proportional band, or increasing the integration time increases the speed on the controller's response; but past a certain point, system stability will be disturbed. All closed-loop control systems have a stability limit.

This stability limit along with the two types of surge upsets previously mentioned perpetrate the need for two different modes of anti-surge control operation. When the control system is operating in the normal surge mode, the control system is maintained within the stability range of the controller by setting the gain of the controller at a low level. When the control system reaches an emergency surge condition, control system stability is sacrificed to achieving protection for the compressor and the gain of the controller is driven beyond normal stable operation limits.

In view of the foregoing it will be seen that one aspect of the present invention is to provide a single loop control system that will control both normal and emergency surge conditions.

Another aspect of the present invention is to provide a single loop surge control system having a variable gain controller whose gain is determined by the intensity of the surge condition.

These and other aspects of the present invention will become apparent after consideration of the following description of the preferred embodiment when considered with the drawings.

DESCRIPTION OF THE PREFERRED EMBODIMENT

Figure 1A:
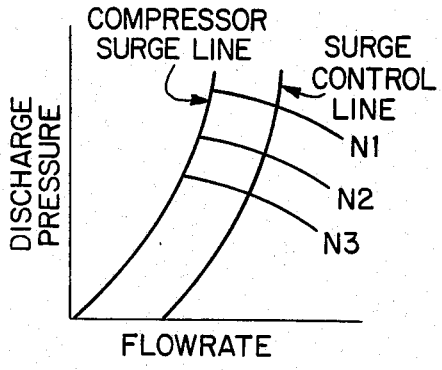
FIG. 1A. (PRIOR ART)
FIGS. 1A–1C are a series of three curves showing prior art surge control lines.
Figure 1B:
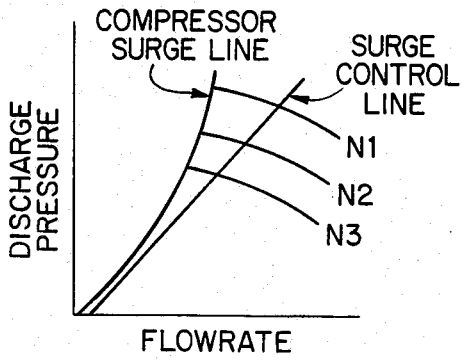
FIG. 1B. (PRIOR ART)
Figure 1C:
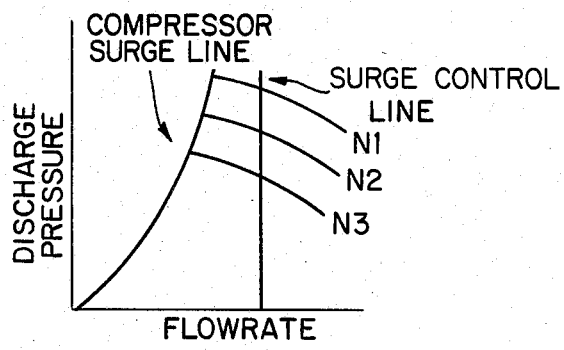
FIG. 1C. (PRIOR ART)
Figure 2:
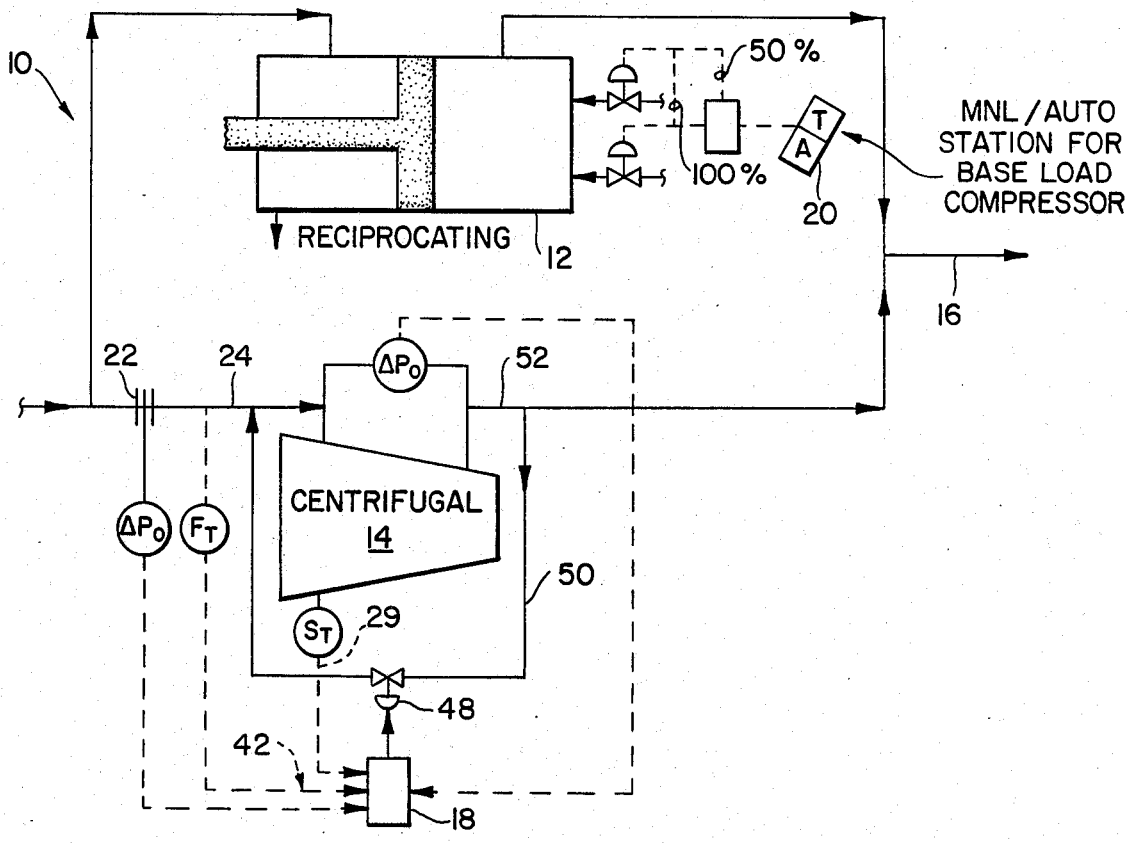
FIG. 2 is a schematic of a compressor using the surge control system of the present invention.

Referring now to the drawings where the showing are to depict a preferred embodiment of the invention but not limit the invention thereto, FIG. 2 shows a parallel compressor system 10 having a reciprocating compressor 12 parallel connected to a centrifugal compressor 14 used to provide an output pressure at output line 16. The reciprocating compressor 12 acts as the base load machine, which can operate normally in one of two different capacities; 50% and 100% of its output pressure. This change of capacity from 100% to 50% that initiates the surge condition in compressor 14 and forms the basis of the advance warning system for the surge control system 18.

The centrifugal compressor 14 acts as a booster in the parallel arrangement, and because its a dynamic machine (vs positive displacement like the reciprocating compressor 12) it has the potential of surging because of the decrease in flow.

Figure 3:
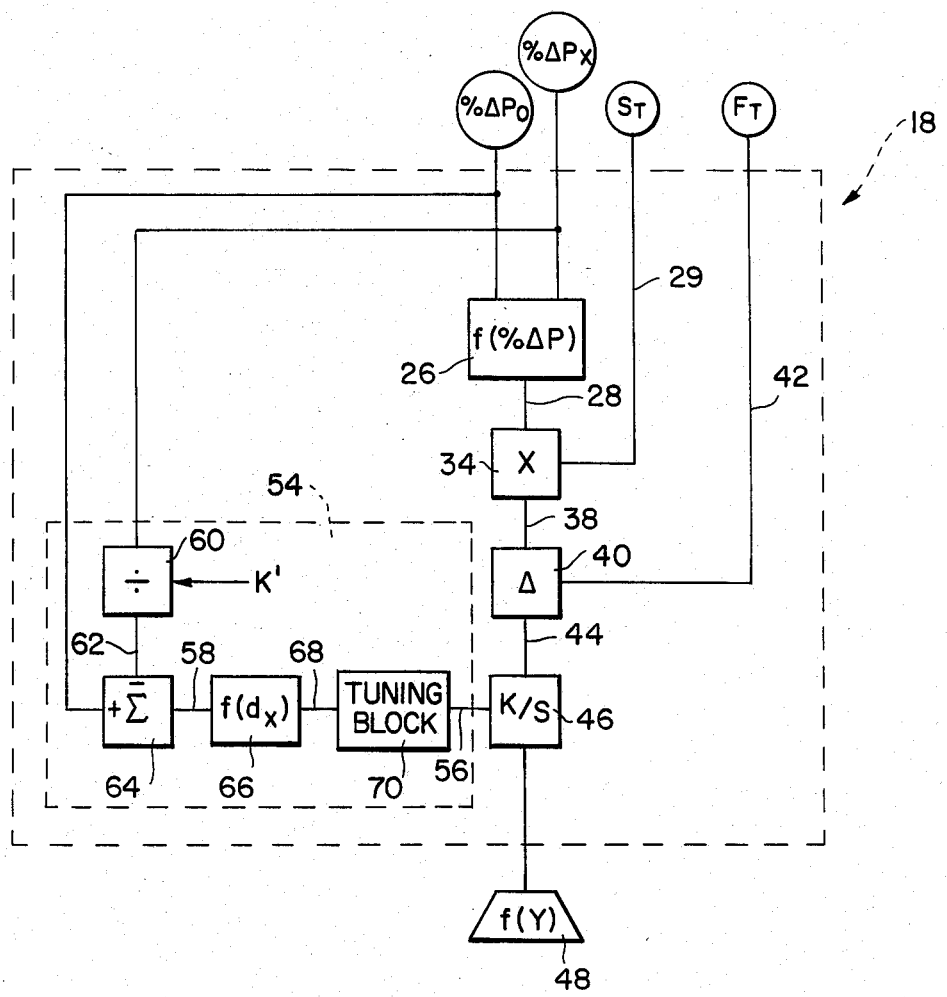
FIG. 3 is a schematic of the surge control system of FIG. 2.

With particular reference to FIG. 3, the surge control system 18 is schematically depicted in SAMA Standard RC22-11-1966 notation with the symbols applicable to mechanical, pneumatic, or electronic control systems.

The measured variables $\%\Delta P_o$ and $\%\Delta P_c$ represent, respectively, the pressure differentials across an orifice 22 in an inlet line 24 of the centrifugal compressor 14 and the differential pressure across said centrifugal compressor 14. These measured variables are inputted into a function generator 26 which develops an output at line 28 representative of surge control line 30 which is substantially parallel and a predetermined distance d to the right of compressor surge line 32 as may be best seen in FIG. 4.

A multiplying station 34 multiplies the surge control line outputted along line 28 with measured speed $S_T$ of the centrifugal compressor 14 outputted along line 29, thus, locating an intersection 36 of a particular compressor rotation speed point $N_i$ and the surge control line 30.

This point 36 defines a certain centrifugal compressor 14 flow rate which is outputted along line 38 and compared in a difference station 40 with an actual measured compressor flow rate $F_T$ supplied along line 42 to the difference station 40.

The output from the difference station 40 is provided along line 44 to a proportional and integral action controller 46 having a predetermined set point which will then control final control element 48; namely, the valve controlling the amount of bypass in line 50 to stop the surge condition by allowing the starved centrifugal compressor 14 inlet line 24 to utilize centrifugal compressor 14 outlet fluid from line 52.

The remaining circuitry is an adaptive gain control module generally designed 54 which is utilized to develop a gain factor according to the invention wherein additional gain is inputted along line 56 to the proportional and integral action controller 46 in proportion to the varying size of a disturbance sensed along line 58 to provide the bypass valve 48 a stepping open action.

The symbols used here have the following meanings:

$\Delta P_o$=pressure differential across an inlet orifice (inches water)

$\Delta P_c$=pressure differential across the centrifugal compressor (PSI)

K=constant which represent the compressor surge line characteristics of a particular compressor $f_o$=calibrated span of the inlet orifice pressure transmitter (e.g., 0–14 inches $H_2O$ produces 0–100% output) (%)

$f_c$=calibrated span of the centrifugal compressor differential pressure transmitter (e.g. 0–400 PSI produces 0–100% output) (%)

d=offset from the surge line expressed as a percentage of the maximum value of $P_o$ (e.g., for an offset of 1.4 inches water when $P_o$ maximum=14 inches water, d=10%) (%)

G=Gain factor of the proportional and integral controller (dimensionless)

It is well known that the compressor surge line may be expressed as follows:

$$(\Delta P_c/\Delta P_o) = K \quad (1)$$

$$\text{or: } \Delta P_c - K\Delta P_o = 0 \quad (2)$$

$$\text{Similarly: } \frac{\Delta P_c}{f_c} - K'\frac{\Delta P_o}{f_o} = 0 \quad (3)$$

$$\text{where: } K' = (f_o/f_c)K \quad (4)$$

$$\text{Defining: } \% \Delta P_c = \frac{\Delta P_c}{f_c} \quad (5)$$

$$\text{and: } \% \Delta P_o = \frac{\Delta P_o}{f_o} \quad (6)$$

and substituting into equation (3) yields:

$$\% \Delta P_c - K' \% \Delta P_o = 0 \quad (7)$$

Similarly, the equation for a line parallel to the compressor surge line but horizontally offset from the compressor surge line by some value d may be expressed as:

$$\% \Delta P_c - K' \% \Delta P_o = -d K' \quad (8)$$

$$\text{or: } d = \frac{-\% \Delta P_c + \% \Delta P_o}{K'} \quad (9)$$

Note that when the value of d in equation (9) is equal to zero, equation (9) is equivalent to equation (7), which defined the compressor surge line.

Figure 4:
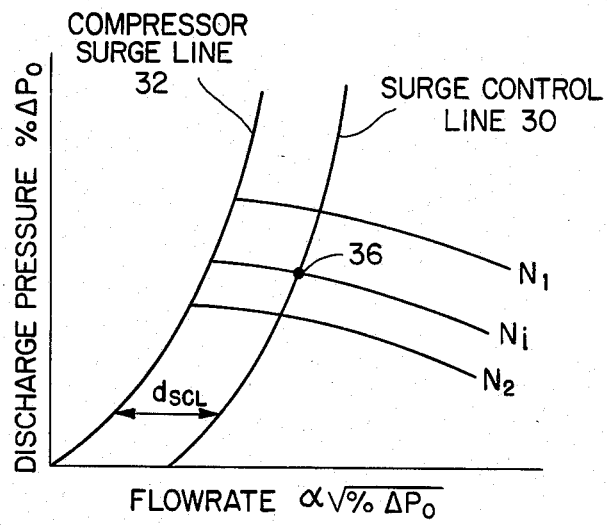
FIG. 4 is a curve of compressor discharge pressure vs. flow rate showing the relationship of the surge control line to the compressor surge line.

For different values of d (i.e., $d_1$, $d_2 \ldots d_i$), a family of lines parallel to the surge line will be generated. If d was limited to a single specific value, e.g., 10%, the line generated is normally referred to as the surge control line as shown in FIG. 4, line 30.

Figure 5:
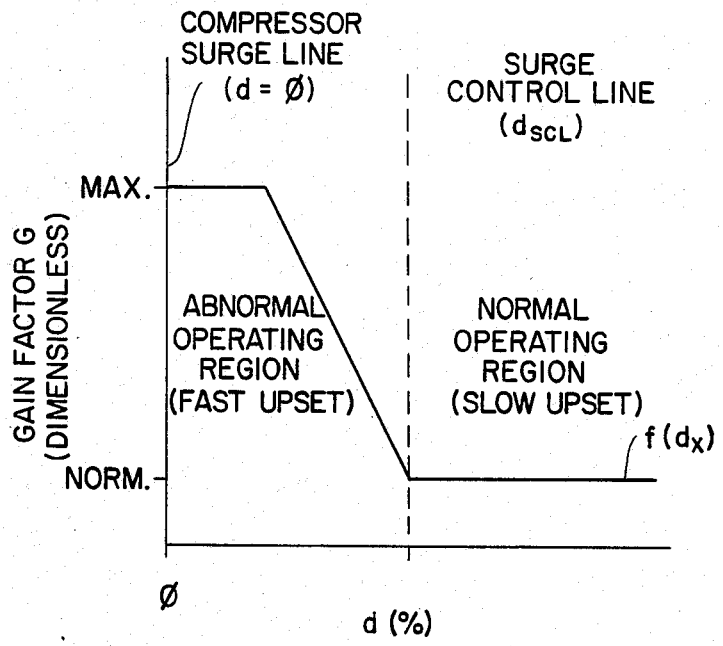
FIG. 5 is an illustration of the adaptive gain factor shown as a function of d.

Based on emperical testing of various compressor arrangements, an optimum gain factor G can be determined for each value of d as seen in FIG. 5. The values of G will typically be 4 to 12 for d equal to between 0 to 40% but the exact values are dependent on the specific compressors, combination of compressors, and piping arrangement used.

In operation the measured variable % $\Delta P_c$ and the constant K' are inputted into dividing station 60 which develops an output at line 62. The measured variable % $\Delta P_o$ and the output at line 62 are then inputted to a summing station 64 which develops an output at line 58 representative of d as defined by equation (9).

A function generator 66 is set up to produce a predetermined value for G for each value of d sensed along line 58 as may best be seen in FIG. 5. A normal or stable system gain factor G is used in normal modulating control (slow upset). But as the value of d approaches a set level (fast upset), additional gain is inputted along line 68 to a tuning block 70 which interfaces with the proportional and integral action controller 46 which, in turn, provides the bypass valve 48 a stepping open action.

The proportional-plus-integral controller 46 has an antiwindup feature. The antiwindup feature is necessary due to the nature of the proportional and integral functions. Normally, the centrifugal compressor 14 operates in an area some distance from the surge control line 30, resulting in an offset between the measurement and the set point of the controller. As a result, the output signal winds up to its low limit.

Antiwindup adjusts the integral loading to shift the proportional band to the same side of the control line that the measurement is on when the controller reaches its output limit. Then, if the control line is approached rapidly, the measurement enters the proportional band and control starts before the value reaches the control line. Thus, overshoot is eliminated.

Derivative control is not used because it can open the anti-surge valve far from the surge line and can cause system oscillations. Rapid oscillations in flow, even in the safe operating zone, can cause the valve to open because of the characteristics of the derivative response.

Certain modifications and improvements have been deleted herein for the sake of conciseness and readability but are properly within the scope of the following claims.

We claim:

1. An adaptive gain surge control system for a centrifugal compressor having an associated surge line and a bypass line comprising:

a proportional and integral mode controller for controlling the bypass line of the compressor having a variable gain setting;

first means for determining the distance d between a surge control line and the compressor surge line;

second means for establishing a control signal in response to the distance d for changing the gain of said controller;

bypass valve control means connected to said controller for varying the amount of bypass across the compressor in response to the control signal therefrom; and wherein said proportional and integral mode controller includes an antiwindup adjustment to adjust the integral mode of the controller to shift the proportional band of the proportional mode of the controller to the same side of the control line the measurement is on when the controller reaches it output limit to prevent overshoot thereby.

2. A surge control system as set forth in claim 1 wherein said second means includes a function generator for establishing a controller gain signal as a function of the distance d.

3. An adaptive gain surge control as set forth in claim 1 wherein said controller is only a proportional and integral function controller having no derivative mode to prevent system oscillation.

* * * * *